US009763842B2

(12) United States Patent
Sauser

(10) Patent No.: US 9,763,842 B2
(45) Date of Patent: Sep. 19, 2017

(54) FLUIDIZABLE BED WITH LATERAL ROTATION CAPABILITY AND METHOD OF OPERATION THEREFOR

(75) Inventor: Frank Sauser, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 668 days.

(21) Appl. No.: 13/568,963

(22) Filed: Aug. 7, 2012

(65) Prior Publication Data

US 2014/0000039 A1 Jan. 2, 2014

Related U.S. Application Data

(60) Provisional application No. 61/665,064, filed on Jun. 27, 2012.

(51) Int. Cl.

| | |
|---|---|
| ***A61G 7/05*** | (2006.01) |
| ***A61G 7/08*** | (2006.01) |
| ***A61G 7/057*** | (2006.01) |
| ***A61G 7/008*** | (2006.01) |

(52) U.S. Cl.
CPC ..... *A61G 7/05746* (2013.01); *A61G 7/008* (2013.01)

(58) Field of Classification Search
CPC ..... A61G 7/05746; A61G 7/008
USPC ..... 5/689, 702, 655.4, 911, 713, 715, 710, 5/615
See application file for complete search history.

(56) References Cited

U.S. PATENT DOCUMENTS

| | | | | |
|---|---|---|---|---|
| 3,340,551 | A * | 9/1967 | Hopkins | 5/689 |
| 3,485,240 | A * | 12/1969 | Fountain | 601/148 |
| 3,866,606 | A * | 2/1975 | Hargest | 606/242 |
| 4,279,044 | A * | 7/1981 | Douglas | 5/714 |
| 4,483,029 | A * | 11/1984 | Paul | 5/689 |
| 4,637,083 | A * | 1/1987 | Goodwin | 5/689 |
| 5,539,943 | A * | 7/1996 | Romano | 5/655.5 |
| 5,966,763 | A * | 10/1999 | Thomas et al. | 5/715 |
| 6,145,142 | A * | 11/2000 | Rechin et al. | 5/706 |
| 6,721,979 | B1 | 4/2004 | Vrzalik et al. | |
| 7,712,171 | B2 * | 5/2010 | Butler | 5/715 |
| 2009/0205139 | A1 * | 8/2009 | Van Deursen et al. | 5/713 |

FOREIGN PATENT DOCUMENTS

| | | | |
|---|---|---|---|
| EP | 0194868 B1 | 9/1986 | |
| WO | WO 9118578 A1 * | 12/1991 | A61G 7/047 |

* cited by examiner

*Primary Examiner* — Eric Kurilla
(74) *Attorney, Agent, or Firm* — Kenneth C. Baran

(57) ABSTRACT

A fluidizable bed (10) comprises a receptacle (12), a diffuser board (14) dividing the receptacle (12) into a plenum (16) and a fluidizable medium container (20), a fluidizable medium (30) residing in the container, and a partition (32) dividing the plenum (16) into a first chamber (34) adapted to receive a first stream (36) of fluidizing medium (30) and a second chamber (40) adapted to receive a second stream (42) of fluidizing medium (30). In operation a first stream (36) of the fluidizing medium (30) is admitted to the first chamber (34) and a second stream (42) of the fluidizing medium (30) is admitting to the second chamber (40). By admitting the fluidizing medium (30) to the chambers in a phased, cyclic fashion the benefits of lateral rotation are achieved in a fluidizable bed (10).

17 Claims, 6 Drawing Sheets

FLUIDIZABLE BED WITH LATERAL ROTATION CAPABILITY AND METHOD OF OPERATION THEREFOR

TECHNICAL FIELD

The subject matter described herein relates to fluidizable beds and particularly to a fluidizable bed having the capability to laterally rotate an occupant of the bed.

BACKGROUND

A typical fluidizable bed includes a receptacle and a porous diffuser board that divides the receptacle into a plenum and a fluidizable medium container above the plenum. A quantity of a fluidizable medium, such as tiny spherical particles, occupies the fluidizable medium container. A filter sheet overlies the fluidizable medium. In operation a fluidizing medium such as ambient air is pressurized and introduced into the plenum. The air flows through the diffuser board, through the fluidizable medium, and exhausts through the filter sheet. The flow of air through the fluidizable medium imparts fluid-like properties to the fluidizable medium so that the medium acts as a quasi-fluid. Fluidizable beds are used for burn victims or other patients who have skin disorders such as pressure ulcers or who are at high risk of developing skin disorders as a result of long term confinement in bed.

Despite the advantages of fluidizable beds they do not offer other therapeutic benefits such as lateral rotation therapy. Lateral rotation therapy involves gently rotating a patient laterally left and right to help prevent pulmonary complications. Lateral rotation capability is easily incorporated in a non-fluidizable bed by providing left and right longitudinally extending, inflatable bladders beneath the occupant support mattress. In operation the left bladder is inflated by a prescribed amount to turn a supine bed occupant to his right. The left bladder is then deflated, and the right bladder is inflated to turn the occupant toward his left. The bladders may also be used in a "turn and hold" mode in which one of the bladders is inflated, maintained in its inflated state for a period of time, and then deflated without a similar inflation and deflation sequence being applied to the other bladder. This mode of operation may be used to, for example, assist a caregiver in turning a bed occupant from supine to prone or vice versa. However introducing lateral rotation bladders into a fluidizable bed, whether to carry out lateral rotation therapy, "turn and hold" or for any other reason would defeat the many benefits of using a fluidizable bed.

SUMMARY

A fluidizable bed comprises a receptacle, a diffuser board dividing the receptacle into a plenum assembly and a fluidizable medium container, a fluidizable medium residing in the container, and a partition dividing the plenum into a first chamber adapted to receive a first stream of fluidizing medium and a second chamber adapted to receive a second stream of fluidizing medium. In operation a first stream of the fluidizing medium is admitted to the first chamber and a second stream of the fluidizing medium is admitting to the second chamber. By admitting the streams of fluidizing medium to the chambers in a phased, cyclic fashion the benefits of lateral rotation are achieved in a fluidizable bed.

BRIEF DESCRIPTION OF THE DRAWINGS

The foregoing and other features of the various embodiments of the fluidizable bed described herein will become more apparent from the following detailed description and the accompanying drawings in which.

DETAILED DESCRIPTION

Figure 1:
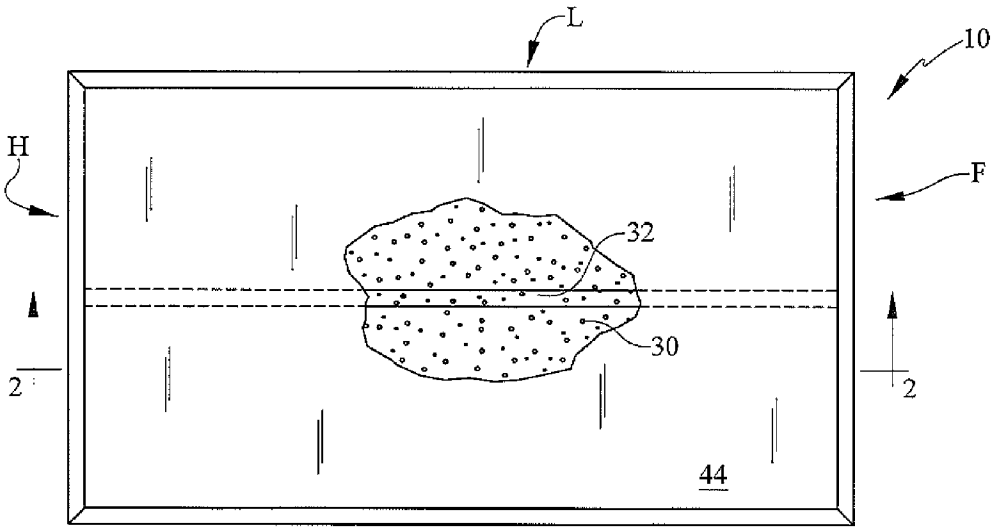
FIG. 1 is a schematic plan view of a fluidizable bed with a filter sheet component of the bed partly broken away to reveal a partition dividing a plenum into left and right chambers.
Figure 2:
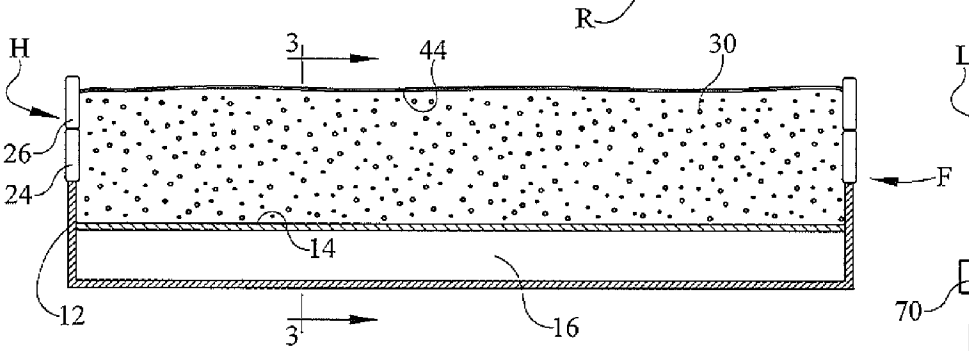
FIG. 2 is a side elevation view taken in the direction 2-2 of FIG. 1
Figure 3:
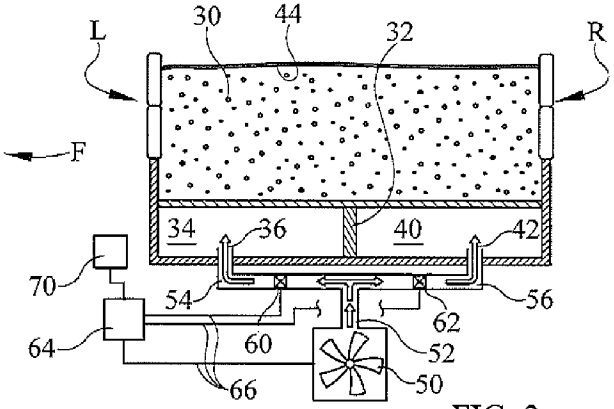
FIG. 3 is a foot end elevation view taken in the direction 3-3 of FIG. 2.

Referring to FIGS. 1-3 a fluidizable bed 10 extends longitudinally from a head end H to a foot end F and laterally from a left side L to a right side R. The bed 10 comprises a receptacle 12 and a porous diffuser board 14 dividing the receptacle into a plenum 16 and a fluidizable medium container 20. The uppermost portion of the receptacle walls is show as upper and lower air bladders 24, 26 and is sometimes referred to as an air wall. A fluidizable medium 30 resides in the container. A longitudinally extending partition 32 divides the plenum into a first or left chamber 34 adapted to receive a left stream 36 of fluidizing medium and a second or right chamber 40 adapted to receive a right stream 42 of fluidizing medium. A filter sheet 44 covers the fluidizable medium.

A blower 50 is connected to the left and right chambers 34, 40 by a conduit 52 having left and right branches 54, 56. Each branch includes a flow regulating valve 60, 62. A controller 64 controls operation of the valves and blower to control admission of the fluidizing medium to chambers 34, 40. The illustration suggests the use of physical communication paths 66 from the controller to the blower and valves, however wireless communication could be used instead. A user interface 70 receives instructions for the controller from a user such as an occupant or caregiver.

Figure 4:
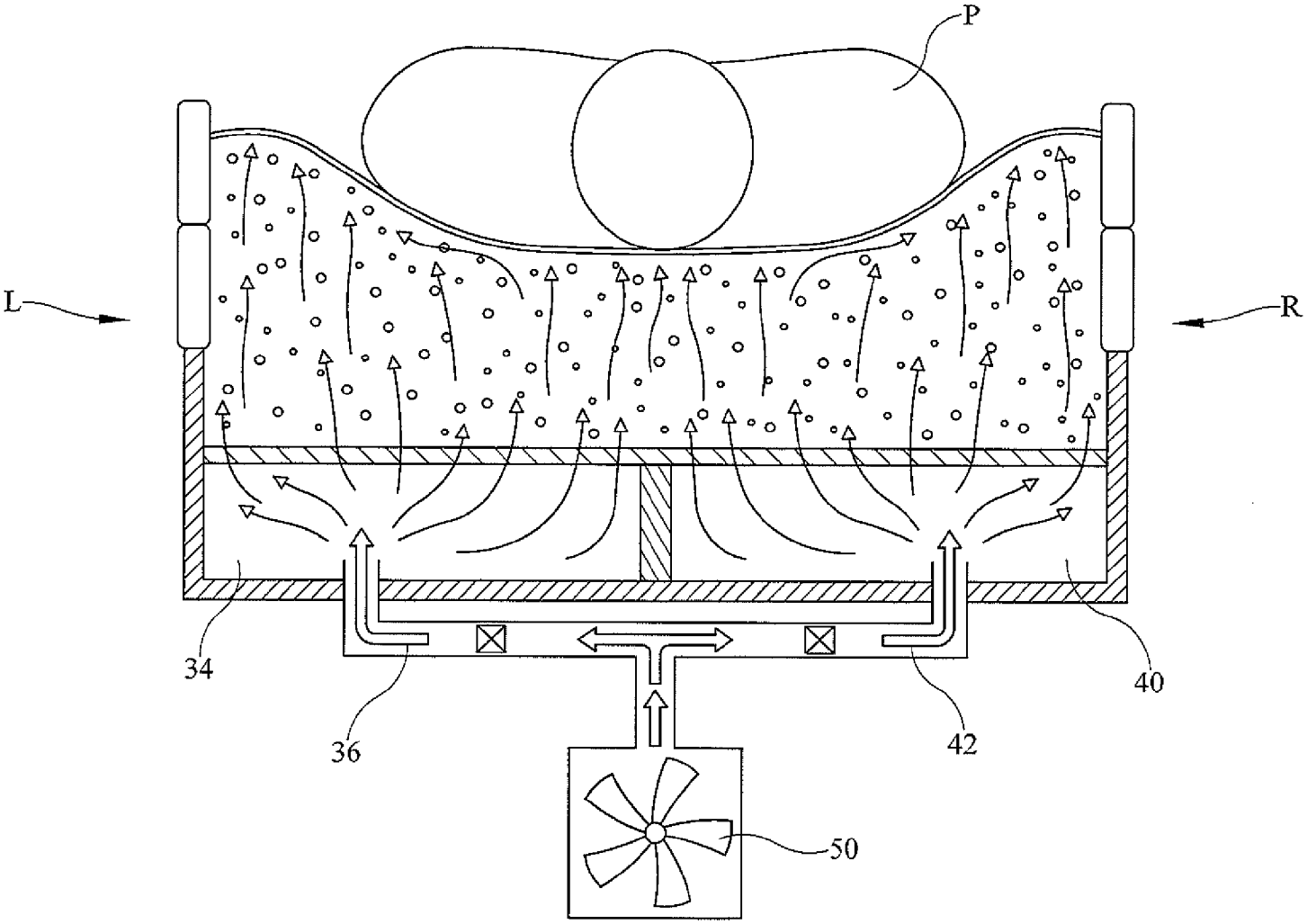
FIGS. 4-6 are schematic head end elevation views of the bed and a supine bed occupant showing the occupant unrotated, rotated to his left, and rotated to his right respectively.
Figure 5:
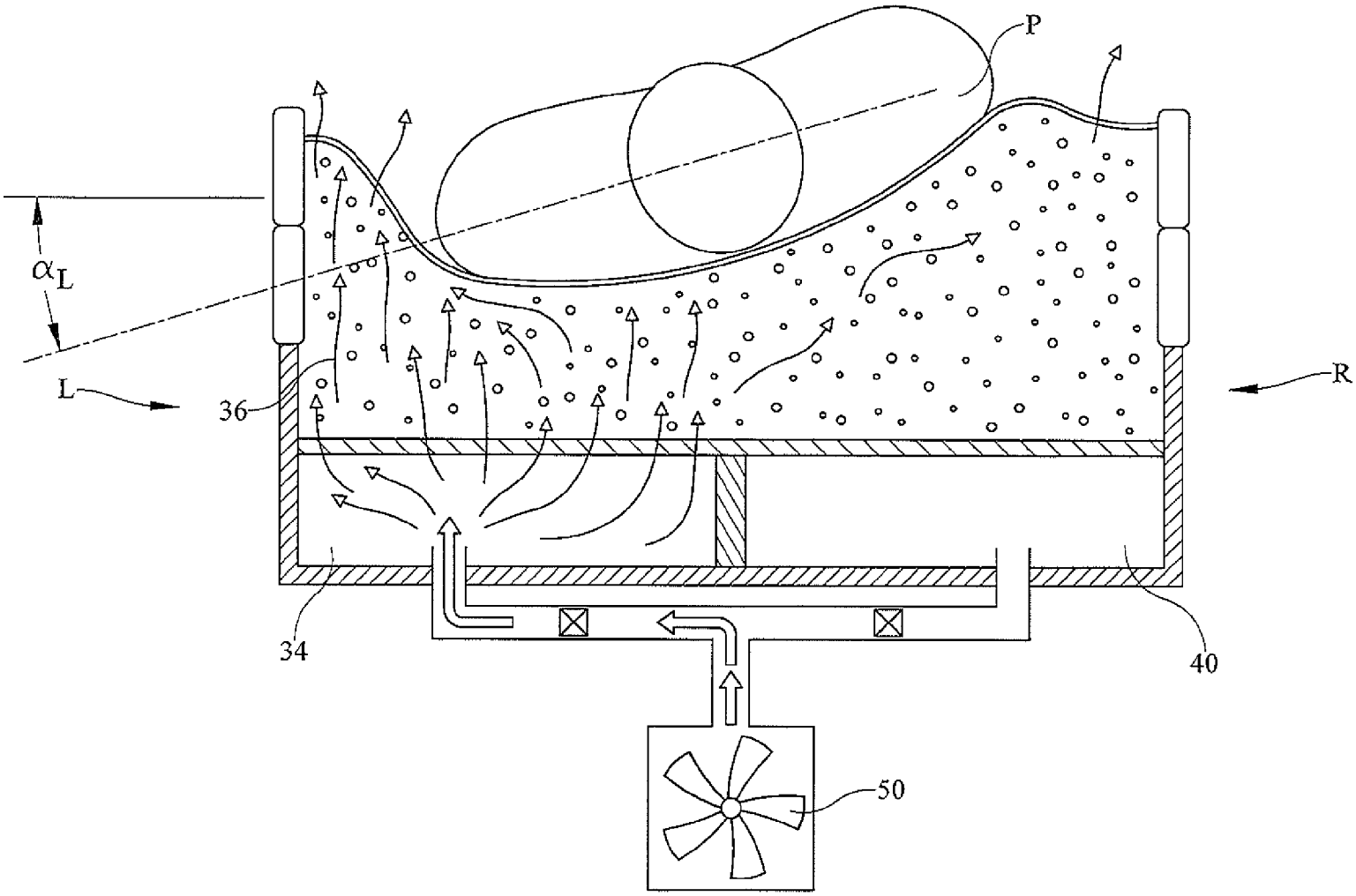
Figure 6:
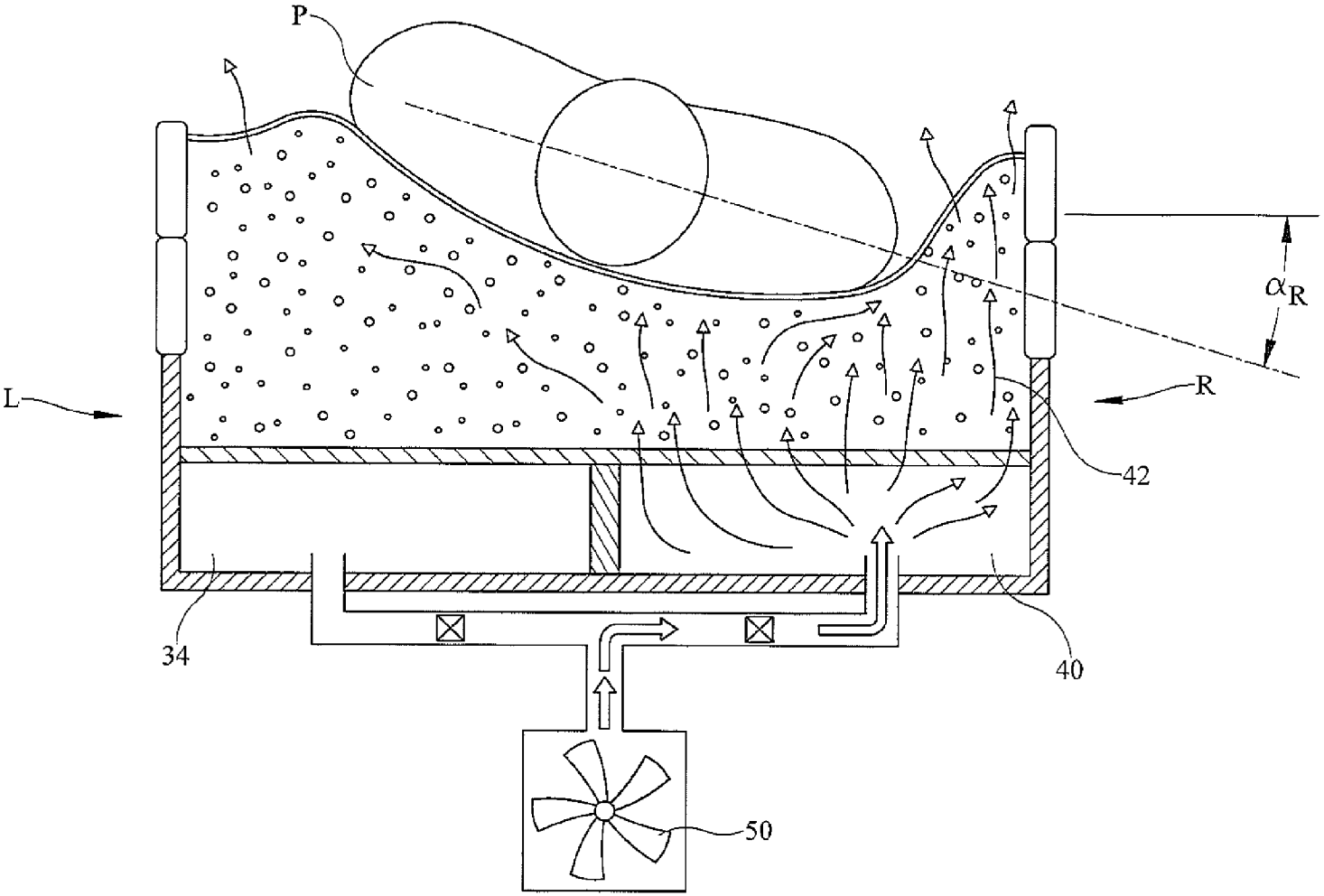

Referring to FIGS. 4-7 a user uses the user interface 70 to select lateral rotation therapy and to specify its parameters such as angular amplitude $\alpha$, cycle frequency or period T, (FIG. 7) pause times at one or more angular orientations and duration of the therapy (i.e number of rotation cycles). In response, the controller, commands cyclic admission of the fluidizing medium to first chamber 34 out of phase with cyclic admission of the fluidizing medium to second chamber 40. As seen in FIG. 5, when the fluidizing medium is admitted to left chamber 34 the fluidizable medium is fluidized on the left side of the bed but remains substantially nonfluidized on the right side. As a result the occupant P sinks slightly into the medium with his left side at a lower elevation than his right side. It should be noted that tension in filter sheet 44 plays no meaningful role in supporting the occupant. Rather, his support is provided by buoyancy arising from the fluidized medium. As seen in FIG. 6, when the fluidizing medium is admitted to right chamber 40 the fluidizable medium is fluidized on the right side of the bed but remains substantially nonfluidized on the left side. As a result the occupant sinks slightly into the medium with his right side at a lower elevation than his left side. Alternating admission of the fluidizing medium to the left and right chambers causes the occupant to undergo lateral rotation between the orientations of FIGS. 5 and 6. The user may also employ "turn and hold" in which the controller commands positive admission of the fluidizing medium to the first chamber and refrains from commanding fluid admission to the second chamber. At the conclusion of the "turn and hold" event fluid admission to the first chamber is discontinued without subsequently admitting fluid to the second chamber.

Figure 7:
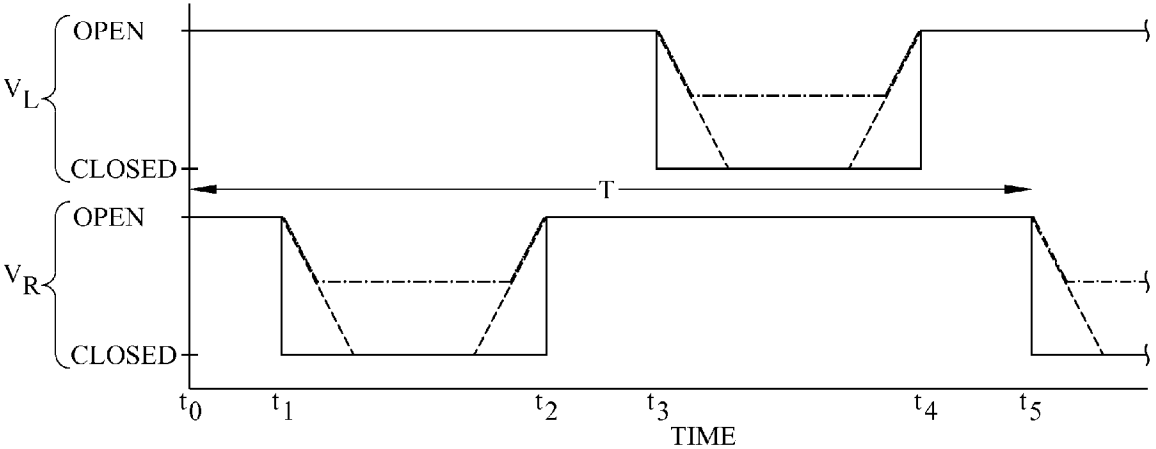
FIG. 7 is a graph showing valve position as a function of time for admitting a fluidizing medium cyclically into the plenum chambers such that the admission into one chamber is out of phase with admission to the other chamber, and also showing certain variations on the profile of fluid admission.
Figure 8:
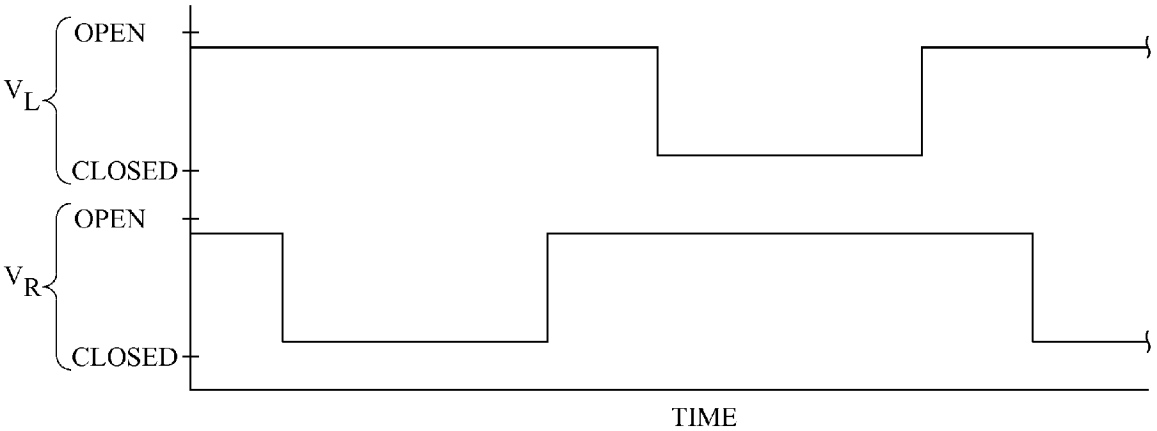
FIG. 8 is a graph similar to that of FIG. 7 showing another variation on the profile of fluid admission.

FIGS. 7-8 show example therapy profiles in which admission or nonadmission of fluidizing medium into chambers 34, 40 is regulated by left & right valves 60, 62, which are designated as $V_L$ and $V_R$ on the vertical axis of each graph. In the profile corresponding to the solid lines of FIG. 7 both valves are initially open so that fluidizing medium is admitted to both chambers 34, 40 resulting in no angular displacement of the occupant (FIG. 4). At t1 valve $V_R$ is closed thereby rotating the occupant to his left as seen in FIG. 5. At time t2 valve $V_R$ is opened while valve $V_L$ remains open, temporarily returning the occupant to the nonrotated orientation of FIG. 4. At time t3 valve $V_L$ is closed thereby rotating the occupant to his right as seen in FIG. 6. At time t4 valve $V_L$ is opened while valve $V_R$ remains open, again returning the occupant to the nonrotated orientation of FIG. 4. At time t5 valve $V_R$ is opened a second time and the cycle begins to repeat. The cycle may be repeated as often as desired. As is evident from FIG. 7 the out of phase admission of fluidizing medium to chambers 34, 40 includes a time interval of concurrent fluid admission to both chambers (t2 to t3 and t4 to t5). Alternatively the controller could be configured so that the out of phase admission of fluidizing medium includes a time interval of concurrent fluid nonadmission to both chambers. During the interval of nonadmission the fluidizable medium would become nonfluidized. The occupant's orientation would be similar to that of FIG. 4, but the occupant's weight would be reacted by the particles of the fluidizable medium collectively acting essentially as a solid rather than by a buoyant force attributable to a quasi-fluid.

Continuing to refer to FIG. 7, the therapy profile corresponding to the dashed line is similar to that of the solid line profile but with a more gradual transition of the valves between their open and closed states. The dash-dot profile recognizes that defluidization does not necessarily require complete closure of valve 60 or 62. FIG. 8 shows that fluidization can occur with a valve 60, 62 less than fully open.

In general the cyclic admission of fluidizing medium to the first chamber has a first upper mass flow rate amplitude corresponding to valve 60 being sufficiently open to fluidize the medium, and also has a first lower mass flow rate amplitude which is less than the first upper flow rate amplitude and corresponds to valve 60 being sufficiently closed to defluidize the medium. Similarly, cyclic admission of the fluidizing medium to the second chamber has a second upper mass flow rate amplitude and a second lower mass flow rate amplitude which is less than the second upper flow rate amplitude. At least one of the lower mass flow rate amplitudes may be zero. Typically the system will be designed so that the first and second upper mass flow rates are substantially equal to each other and the first and second lower mass flow rates are substantially equal to each other. However designs in which the first and second upper mass flow rates are not substantially equal to each other and/or the first and second lower mass flow rates are not substantially equal to each other are also contemplated.

Figure 9:
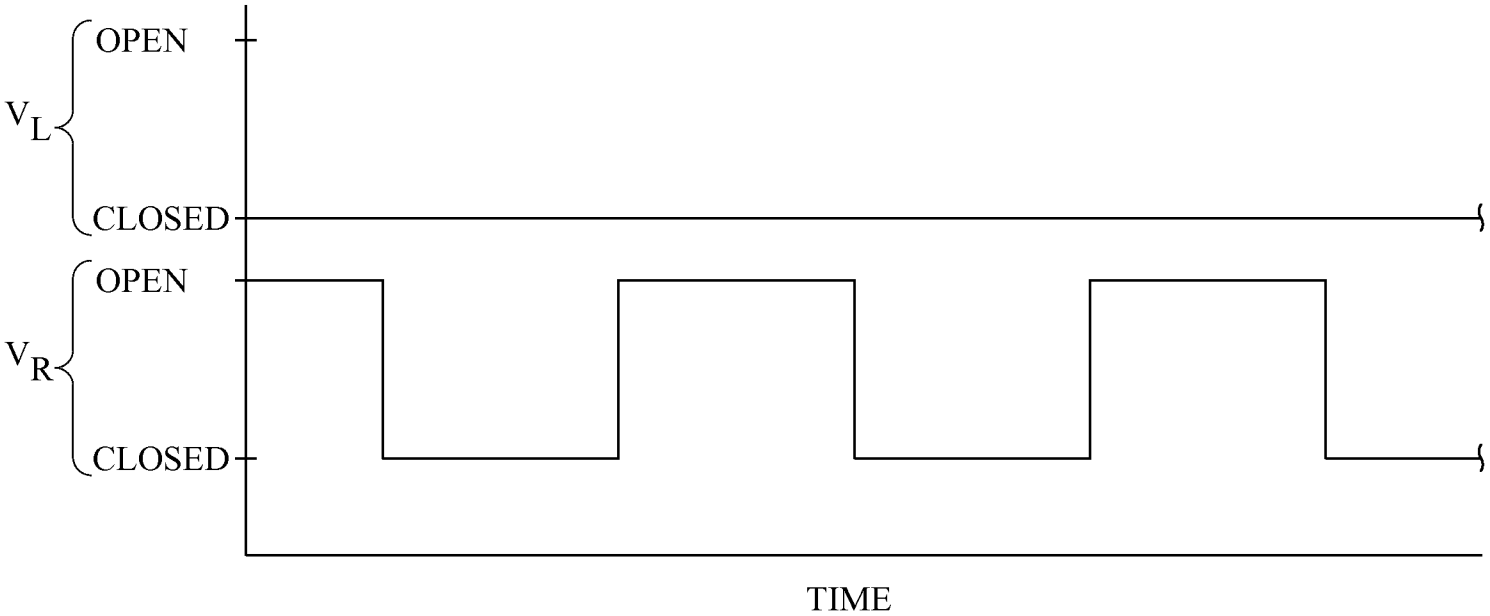
FIG. 9 is a graph similar to those of FIGS. 7-8 showing a unilateral profile of fluid admission.

The mode of operation described above is bilateral in that the occupant is rotated both to his left and to his right. However as seen in FIG. 9 unilateral operation can be achieved if desired by configuring the controller to respond to a user input such that the controller commands cyclic admission of the fluidizable medium to one of the chambers and noncyclic admission (which includes nonadmission) to the other chamber. As with the bilateral variant the cyclic admission of fluidizing medium to the selected chamber has an upper mass flow rate amplitude and a lower mass flow rate amplitude which is less than the upper flow rate amplitude and which may be as low as zero. "Turn and hold" operation may also be achieved in which the admission of fluidizing medium to the first chamber has a positive mass flow rate and the admission to the second chamber is a nonadmission having a zero mass flow rate. As already noted discontinuance of admission of fluidizable medium to the first chamber would not be followed by positive admission to the second chamber. In FIG. 9 an example of "turn and hold" operation corresponds to the portion of the graph up to and including the first transition from "open" to "closed" for valve W.

In the foregoing examples the rates of admission of fluidizing material to the chambers are controlled by operating a valve. Alternatively, similar results may be achieved by regulating the performance, e.g. the operating speed, of a blower. In addition, although the examples show a single partition dividing the plenum into two chambers, a greater number of partitions dividing the plenum into a greater number of chambers could also be used.

Although this disclosure refers to specific embodiments, it will be understood by those skilled in the art that various changes in form and detail may be made without departing from the subject matter set forth in the accompanying claims.

I claim:

1. A fluidizable bed comprising:

a receptacle;

a diffuser board dividing the receptacle into a plenum and a fluidizable medium container;

a fluidizable medium residing in the container; and a partition dividing the plenum into a first chamber adapted to receive a first stream of fluidizing medium and a second chamber adapted to receive a second stream of fluidizing medium;

a controller for controlling admission of the fluidizing medium to the chambers, wherein the controller commands one or more cycles of positive admission of the fluidizing medium to the first chamber and commands noncyclic fluid admission to the second chamber during substantially the entire duration of at least one of the one or more cycles of admission to the first chamber.

2. The bed of claim 1 including a user interface for receiving instructions for the controller.

3. The bed of claim 1 wherein the partition is a longitudinally extending partition that divides the plenum into a left chamber adapted to receive a left stream of fluidizing medium and a right chamber adapted to receive a right stream of fluidizing medium.

4. The bed of claim 1 wherein the controller commands cyclic admission of the fluidizable medium to one of the chambers and noncyclic admission to the other chamber.

5. The bed of claim 4 wherein the cyclic admission to the one chamber has an upper mass flow rate amplitude and a lower mass flow rate amplitude which is less than the upper flow rate amplitude.

6. The bed of claim 5 wherein the lower mass flow rate amplitude is zero.

7. The bed of claim 1 wherein the admission of fluidizing medium is controlled by at least one of operating a valve and regulating performance of a blower.

8. The bed of claim 1 wherein the noncyclic admission of fluidizing medium to the second chamber is a positive admission of the medium.

9. The bed of claim 1 wherein the noncyclic admission of fluidizing medium to the second chamber is a nonadmission of the medium.

10. The bed of claim 1 including a user interface in communication with the controller and wherein the controller commands a single cycle of positive admission of fluidizing medium to the first chamber in response to a user command received from a user.

11. The bed of claim 1 wherein the partition defines exactly two chambers.

12. A method of operating a fluidizable bed having a container of a fluidizable medium for supporting a bed occupant and at least first and second chambers beneath the fluidizable medium for distributing a fluidizing medium to the fluidizable medium, the method comprising cyclically admitting a first stream of the fluidizing medium to the first chamber and noncyclically admitting a second stream of the fluidizing medium to the second chamber during substantially the entire duration of at least one cycle of the cyclical admission to the first chamber.

13. The method of claim 12 wherein the cyclic admission to the one chamber has an upper mass flow rate amplitude and a lower mass flow rate amplitude which is less than the upper flow rate amplitude.

14. The method of claim 13 wherein the lower mass flow rate amplitude is zero.

15. The method of claim 12 wherein the admission to the first chamber has a positive mass flow rate and the admission to the second chamber is a nonadmission having a zero mass flow rate.

16. The method of claim 12 wherein the admission to the first chamber has a positive mass flow rate and the admission to the second chamber is a substantially constant nonzero mass flow rate admission.

17. The method of claim 12 comprising a single cycle of admission to the first chamber.

* * * * *